United States Patent [19]

Kawamura

[11] 3,931,540

[45] Jan. 6, 1976

[54] SHADOW MASK ASSEMBLY

[75] Inventor: Takao Kawamura, Mobara, Japan

[73] Assignee: Hitachi, Ltd., Japan

[22] Filed: Apr. 30, 1971

[21] Appl. No.: 139,020

[30] Foreign Application Priority Data

Apr. 30, 1970 Japan ..... 45-36262

[52] U.S. Cl. ..... 313/404; 313/407

[51] Int. Cl.[2] ..... H01J 29/07; H01J 29/02

[58] Field of Search ..... 313/85 S, 92 B

[56] References Cited

UNITED STATES PATENTS

| | | | |
|---|---|---|---|
| 3,349,272 | 10/1967 | Bathelt et al. | 313/85 S |
| 3,387,159 | 6/1968 | Schwartz et al. | 313/85 S |
| 3,449,612 | 6/1969 | Zachrich | 313/85 S |
| 3,524,096 | 8/1970 | Kuryla et al. | 313/85 S |
| 3,524,972 | 8/1970 | Cooper et al. | 313/85 S |

*Primary Examiner*—Robert Segal
*Attorney, Agent, or Firm*—Craig & Antonelli

[57] ABSTRACT

In a shadow mask assembly comprising a substantially rectangular shallow dish shaped shadow mask, a rectangular reinforcing frame having a side surface adapted to engage the periphery of the shadow mask and a transverse flat surface formed by a flange bent inwardly at right angles with respect to the side surface, and a plurality of leaf springs for supporting said shadow mask assembly, there are provided a plurality of depressions formed on the frame at points corresponding to the leaf springs.

3 Claims, 5 Drawing Figures

INVENTOR

TAKAO KAWAMURA

BY Craig, Antonelli & Hill
ATTORNEYS

INVENTOR

TAKAO KAWAMURA

BY Craig, Antonelli & Hill

ATTORNEYS

SHADOW MASK ASSEMBLY

BACKGROUND OF THE INVENTION

This invention relates to a shadow mask assembly adapted to be incorporated into a color cathode ray tube and more particularly to a flat shadow mask assembly.

Generally, a shadow mask assembly comprises a shadow mask, a reinforcing frame to fit and support the shadow mask and leaf springs secured to the frame for supporting the assembly.

More particularly, as shown in FIG. 1, a prior art cathode ray tube for use in a color television receiving set comprises an envelope having a face panel 1 with its inner surface coated in the conventional manner with a film of phosphor in the form of a plurality of phosphor dots, and a shadow mask assembly 2, shown in exploded perspective. The shadow mask assembly includes a rectangular shallow dish-shaped shadow mask 3 provided with a large number of small perforations, for example from 100,000 to 400,000, a reinforcing frame 4 made of a metal strip having an L-shaped cross-section, and an electron shield 5 secured to the reinforcing frame 4, which is fitted in the opening of shadow mask 3 to support the same.

A reinforcing frame, such as frame 4, is generally prepared by drawing a bending line along the length of a flat metal strip cut to a predetermined length, bending the strip along the bending line into an L-shaped cross-section, bending the strip into a rectangular configuration and welding together the opposite ends of the strip. Since the strip is bent within a common plane, each side of the completed frame tends to bulge outwardly due to the resiliency of the strip. Thus, the completed reinforcing frame is somewhat elliptical, resulting in strain or deformation of the shadow mask held thereby. Moreover, since the peripheral edge of the electron shield 5 secured to the reinforcing frame 4 extends outwardly beyond the periphery of the reinforcing frame, it is impossible to project the leaf springs 41 forwardly, as viewed in FIG. 1, beyond the periphery of the electron shield, which leaf springs 41 are secured to the reinforcing frame for the purpose of mounting the shadow mask assembly on the face plate 1. For this reasons, when mounting the shadow mask assembly upon the face plate, it is difficult to mount the assembly by grasping the leaf springs.

One approach to this problem is the use of a curved reinforcing frame, as shown in FIG. 2. The four sides of the reinforcing frame 6 are bent to conform to the curved front surface of the shadow mask 3. To prepare such a curved frame, since three dimensional bending operations are required, the tendency of the reinforcing frame to spring back is small so that the frame does not impart any strain or deformation to the shadow mask fitted therein. With this construction, since it is possible to project the free ends of leaf springs 61 secured to the periphery of the frame 6 beyond the edge of the electron shield, the shadow mask assembly can be mounted upon the face panel by grasping these projected ends. However, with this construction, it is also necessary to form the electron shield to be mounted on the reinforcing frame so that it has curved sides. Further, it is necessary to form notches on the periphery of the electron shield to receive the projecting ends of the leaf springs. Such notches permit electrons to pass thus off-setting the purpose of the electron shield.

SUMMARY OF THE INVENTION

It is an object of this invention to provide an improved shadow mask assembly formed by bending operations in a common plane and is free from the spring back characteristic of the blank from which the frame is fabricated whereby the frame does not strain and deform the shadow mask.

Another object of this invention is to provide an improved shadow mask assembly so constructed that it is possible to grasp the leaf springs secured to the reinforcing frame when mounting the shadow mask assembly upon the face plate even when the electron shield which is fixed to the reinforcing frame formed by the bending operation takes the form of a flat plate.

Still another object of this invention is to provide a novel shadow mask assembly which can be readily fabricated with a configuration and dimension of high accuracy.

According to this invention, in a shadow mask assembly of the class comprising a substantially rectangular flat shallow dish-shaped shadow mask, a rectangular reinforcing frame having an annular side surface adapted to engage the periphry of the shadow mask and a transverse surface formed by a flange bent inwardly at right angles with respect to the side surface, and a plurality of springs for supporting the shadow mask assembly, one end of the leaf springs being secured to the side surface, there are provided a plurality of depressions formed on the flange at points corresponding to the leaf springs.

BRIEF DESCRIPTION OF THE DRAWINGS

Further objects and advantages of the invention will become apparent from the following description of the invention when taken in conjunction with the accompanying drawings in which.

DESCRIPTION OF THE PREFERRED EMBODIMENT

Figure 1:
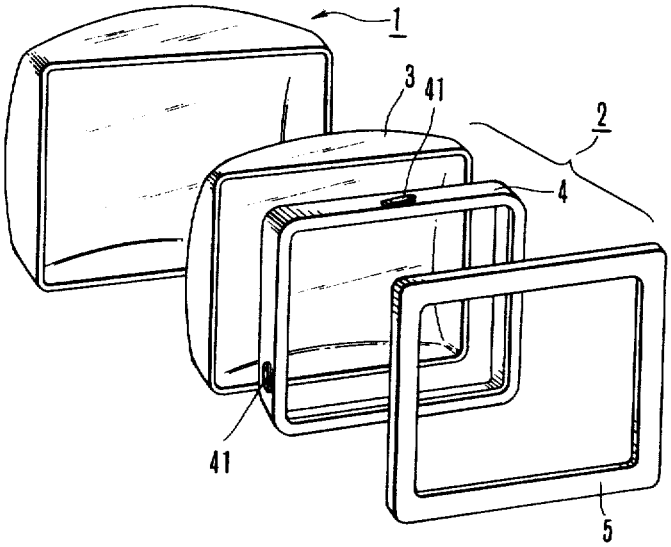
FIG. 1 shows an exploded perspective view of a prior art shadow mask assembly utilizing a plane-type reinforcing frame.
Figure 2:
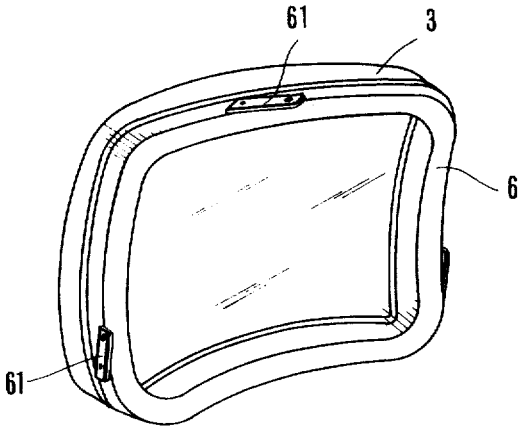
FIG. 2 shows a prior art curved reinforcing frame of the shadow mask assembly.
Figure 3:
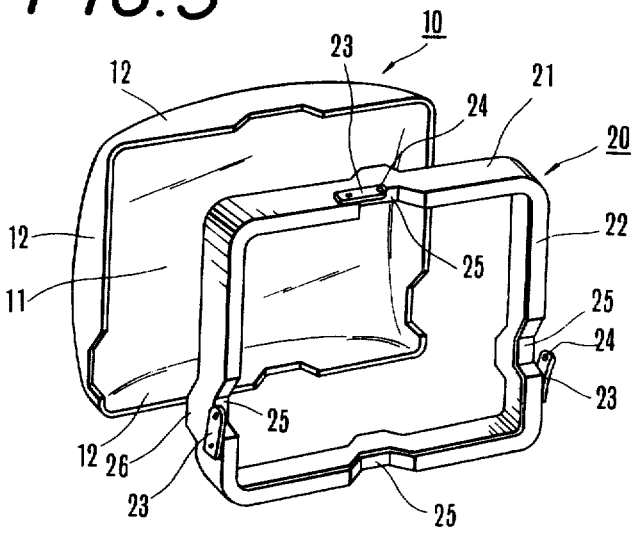
FIG. 3 is an exploded perspective view of a shadow mask and a reinforcing frame embodying the invention.
Figure 4:
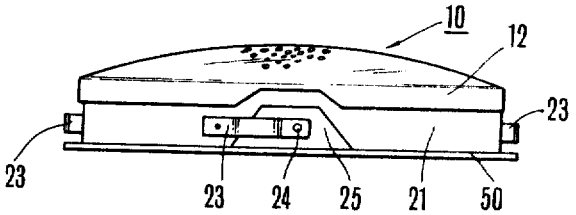
FIG. 4 is a side view of the shadow mask assembly shown in FIG. 3.
Figure 5:
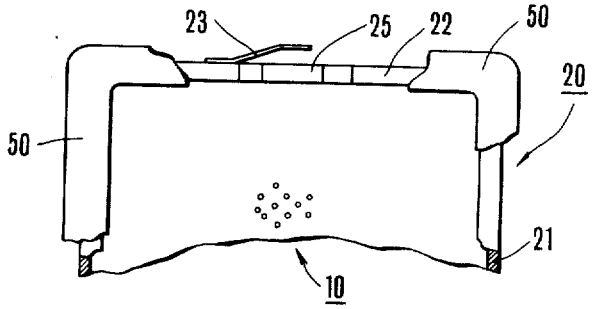
FIG. 5 is a front view, partly broken away, of the novel shadow mask assembly, as seen in the direction of travel of the electron beam.

The novel shadow mask assembly shown in FIGS. 3 to 5 comprises a shadow mask 10 having a rectangular shallow disc configuration which is formed by drawing a thin metal plate and providing the plate with a plurality of small perforations formed by a conventional photoetching technique, for example. As is well known in the art, the shadow mask 10 has an outer dimension slightly smaller than the inner dimension of the face plate of the cathode ray tube. The novel reinforcing frame 20 is in the form of a flat rectangular frame which is fabricated by the steps of bending a metal strip along a longitudinal bending line to have an L-shaped cross-section, and then bending the strip in a common plane at predetermined intervals into a rectangular frame. These bending operations are identical to those described in connection with the reinforcing frame 4 shown in FIG. 1.

The spacings between bending points of the L-shaped frame are determined by the inner dimension of the opening defined by the periphery 12 of the shadow mask 10. For the sake of description, the reinforcing frame 20 of rectangular cross-section is shown as including side surfaces 21 adapted to fit in the shadow mask, and transverse flange surfaces 22 on the flange bent inwardly at right angles with respect to the side surfaces 21. Inner ends of springs 23 for supporting the shadow mask assembly are secured to the vertical surface 21, as by spot welding. The outer ends of the leaf springs are provided with openings 24 for receiving pins (not shown) secured to the inner wall of the face plate.

The invention is characterized by the provision of depressions 25 toward the width of the side surface 21 on the flange surface 22. Such depressions or notches 25 may be formed by press working, concurrently with or independently of the bending operation of the reinforcing frame 20. Projections 26 are formed on the lower edge of the frame as a result of the press working during the forming of the depressions 25. These depressions on the reinforcing frame eliminate the spring back property of the flat reinforcing frame, thus preventing it from deforming or bulging outwardly into a round or elliptical configuration.

As shown in FIGS. 3 to 5, since the free ends of leaf springs 23 are in alignment with depressions 25, it is possible to grasp these leaf springs through these depressions when mounting the shadow mask assembly upon the face panel, thus simplifying the assembling operation. Thus, it will be clear that the depressions provided in accordance with the invention not only improve the accuracy of configuration and dimension of the reinforcing frame, but also eliminate the inconvenience encountered in the mounting operation of the prior art shadow mask assembly utilizing the plane-type frame.

While the invention has been shown and described in terms of a preferred embodiment, it should be understood that the invention is not limited to this particular embodiment. Thus, for example, it is not always necessary to provide one depression for each one of four sides of the rectangular frame, but any number of such depressions may be formed on any side. However, due consideration should be given to the accuracy of the configuration and the rigidity of the reinforcing frame and the number of leaf springs used. Instead of a trapezoid, the depression may take any one of many other configurations, for example, an arc, rectangle or triangle.

What is claimed is:

1. In a shadow mask assembly of the type including a substantially rectangular shallow dish-shaped shadow mask, a rectangular reinforcing frame of L-shaped cross-section having an annular side surface adapted to engage the periphery of said shadow mask and a transverse flat surface formed by a flange bent inwardly at right angles with respect to said side surface, and a plurality of leaf springs for supporting said shadow mask assembly, one end of each of said leaf springs being secured to said side surface, the improvement in which portions of the side surface of said frame in alignment with the free end of at least one pair of leaf springs are deformed to provide a protrusion extending toward the shadow mask and a depression in alignment with said portrusion with said transverse flat surface following said depressions.

2. The shadow mask assembly according to claim 1, wherein said depressions have the configuration of a trapezoid.

3. The shadow mask assembly according to claim 1, wherein the entire width of the transverse flat surface of said frame is discontinuous in the areas of said deformed portions.

* * * * *